United States Patent [19]

Gustafson

[11] 4,276,690

[45] Jul. 7, 1981

[54] METHOD OF ASSEMBLING COMPONENTS OF A THERMOSTAT

[75] Inventor: Ralph W. Gustafson, Morrison, Ill.

[73] Assignee: General Electric Company, Fort Wayne, Ind.

[21] Appl. No.: 76,166

[22] Filed: Sep. 17, 1979

Related U.S. Application Data

[62] Division of Ser. No. 845,383, Oct. 25, 1977.

[51] Int. Cl.[3] ..... H01F 41/02

[52] U.S. Cl. ..... 29/602 R; 29/466; 29/467

[58] Field of Search ..... 29/602 R, 607, 466, 29/467; 335/205, 71, 75, 90, 95, 344, 359, 362, 366

[56] References Cited

U.S. PATENT DOCUMENTS

| | | | |
|---|---|---|---|
| 2,539,259 | 1/1951 | McCabe | 337/71 X |
| 3,222,474 | 12/1965 | Fasola, Jr. | 335/205 |
| 3,573,698 | 4/1971 | Mitick | 337/103 |
| 3,656,082 | 4/1972 | Beck | 335/205 X |

*Primary Examiner*—Carl E. Hall

*Attorney, Agent, or Firm*—Joseph E. Papin

[57] ABSTRACT

A method of assembling a pair of magnetic material elements with an assembly having a bimetal element secured between means for carrying the magnetic material elements and means adapted for supporting the assembly.

11 Claims, 13 Drawing Figures

METHOD OF ASSEMBLING COMPONENTS OF A THERMOSTAT

CROSS REFERENCE TO RELATED APPLICATION

This application is a division of copending application Ser. No. 845,383 filed Oct. 25, 1977, which is incorporated herein by reference.

FIELD OF THE INVENTION

This invention relates generally to temperature responsive devices and in particular to a method of assembling a thermostat and a method of assembling components of a thermostat.

BACKGROUND OF THE INVENTION

In the past, various and sundry different types of thermostats have been employed for effecting regulation of the temperature of a space in which the thermostat may be located, and various different types of means have been employed in such thermostats for sensing the temperature of the space. For instance in some of the past thermostats which employed a temperature sensing means comprising a bimetal element having a generally spiral configuration, such spiral bimetal element had a pair of inner and outer generally radially spaced ends, and the inner end was attached by suitable means to a post rotatably mounted on a base plate of the thermostat casing. The spiral bimetal element and the post were conjointly rotatable in response to the manual adjustment of a temperature selector to a set-point temperature desired for the space in which the thermostat was located. Thus, the spiral bimetal element was rotated to adjusted positions correlative to the set-point temperatures indicated by the temperature selector in response to the manual movement thereof by an operator of the thermostat, and in respective ones of such adjusted positions correlative with the particular selected set-point temperature, the spiral bimetal element expanded or contracted in response to variations in the temperature with respect to such selected set-point temperature of the space in which the thermostat was located. In this manner, the temperature sensing movement, i.e. the aforementioned expansive or contractive movement of the spiral bimetal element, was translated into or was operative to effect a switching operation of the thermostat. In other words, when the thermostat was in a selected one of its heating or cooling operating modes, the temperature sensing movement of the spiral bimetal element was effective to cause a switching operation so as to initate or terminate the operation of a heating or cooling device conditioning the temperature of the space in which the thermostat was located.

Of course, this aforementioned switching operation of the thermostat in response to the temperature sensing movement of the spiral bimetal element was effected in various different manners. For instance, as illustrated in U.S. Pat. No. 3,993,120, either one or a pair of mercury switches were predeterminately positioned on a mounting bracket attached to the radially outer end of the spiral bimetal element so as to be conjointly movable with the spiral bimetal element in response to the temperature sensing movement thereof, and of course, such movement of the mercury switches affected the switching operation thereof so as to control the heating or cooling operating modes of the thermostat. In U.S. Pat. No. 3,656,082, a permanent magnet was attached to the radially outer end of the spiral bimetal element, and the temperature sensing movement of the spiral bimetal element conjointly moved the permanent magnet so as to operate a magnetically actuated reed-type switch associated therewith in order to control the heating or cooling operating modes of the thermostat.

In U.S. Pat. No. 2,539,259 a pair of pivotally movable magnets were respectively driven by the temperature sensing movements of a strip-type bimetal element so as to operate a pair of movable or magnetically actuated electrodes in a mercury switch associated therewith in order to control the heating or cooling operating modes of the thermostat.

In U.S. Pat. No. 3,573,698, one end of a generally U-shaped bimetal element was biased so that the temperature sensing movement of the other end of such bimetal element was correlative with the set-point temperature selected in order to effect the biasing of the one end of such bimetal element. The other end of the generally U-shaped bimetal element carried a pair of armatures respectively movable toward and away from magnetic coupling engagement with a permanent magnet associated therewith and encapsulated in a reed-type switch. The temperature sensing movement of the armature with the generally U-shaped bimetal element attracted the magnet within the reed-type switch between a pair of generally opposite switching positions to control the heating and cooling mode operations of the thermostat.

SUMMARY OF THE INVENTION

Among the several objects of the present invention may be noted the provision of an improved method of assembling components of a thermostat; the provision of such improved method in which magnetic symmetry is predetermined; the provision of such improved method in which a pair of magnets adapted to attract an armature in an encapsulated switch device are arranged to approach the armature generally at the same angles; the provision of such improved method in which a switching device is adjustably assembled so as to be in a predetermined centered position with respect to another part of the thermostat; the provision of such improved method in which a pair of magnet means are predeterminately disposed on carrying means therefor so as to be symmetrically arranged with means for mounting the carrying means to the thermostat as well as being adopted for symmetrical relation with an armature of a switch device of the thermostat; and the provision of such improved method in which the components thereof are simplistic in design, easily assembled, and economically manufactured. These as well as other objects and advantageous features of the present invention will be in part pointed out and in part apparent hereinafter.

In general and in one form of the invention, a method is provided for assembling a pair of magnetic material elements with an assembly having a bimetal element secured between means for carrying the magnetic material elements and means adapted for supporting the assembly. In this method, the carrying means is disposed in a fixed position, and a free position of the supporting means is located with respect to the carrying means in its fixed position. The magnetic material elements are associated with the carrying means therefor, and a preselected section of each magnetic material element is arranged so as to be disposed generally in symmetrical relation with the supporting means in the located free position thereof, respectively.

Further in general, another method in one form of the invention is provided for assembling a pair of magnets with an assembly having a bimetal element secured between means for carrying the magnets and means adapted for supporting the assembly. In this method, the carrying means is disposed in a fixed position, and a free position of the supporting means is located with respect to the carrying means in its fixed position. The magnets are associated with the carrying means in its fixed position, and a preselected section of each of the magnets is attracted into magnetic coupling relation with a pair of means for predeterminately disposing the preselected sections of the magnets generally in symmetrical relation with the supporting means in the located free position thereof.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting, in any manner, the scope of the invention or the disclosure thereof.

DETAILED DESCRIPTION OF THE PREFERRED EMBODIMENTS

Figure 1:
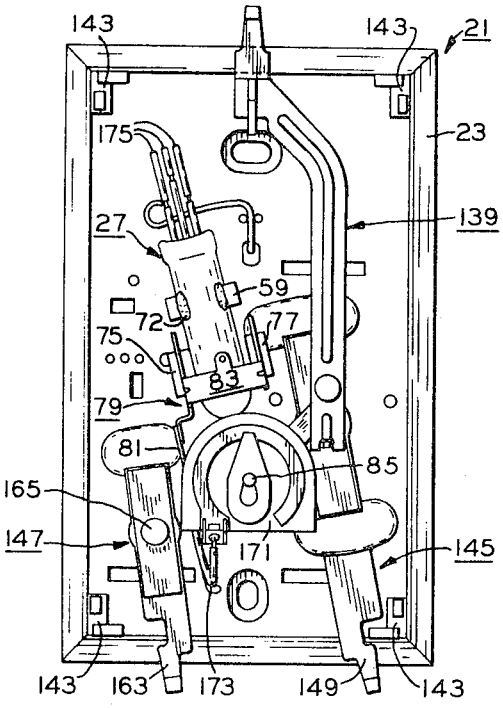
FIG. 1 is a plan view illustrating a thermostat with a cover thereof removed for clarity and also illustrating principles which may be practiced in a method of assembling a thermostat.
Figure 2:
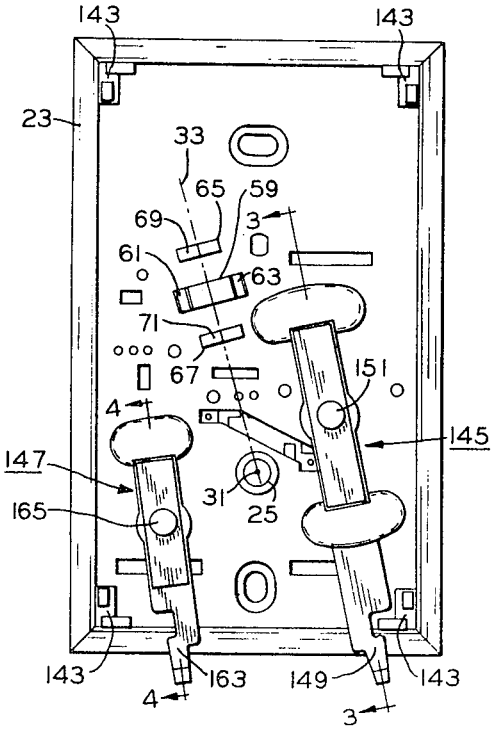
FIG. 2 is a plan view showing a base plate of the thermostat of FIG. 1 with a fan selector switch and a system selector switch mounted thereto.
Figure 5:
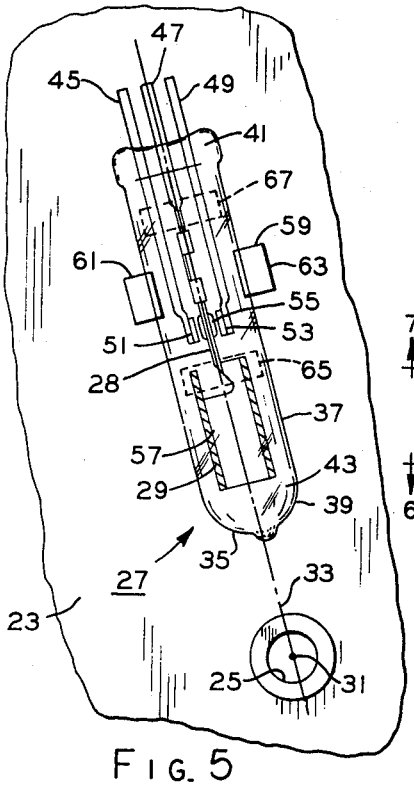
FIG. 5 is an enlarged fragmentary view taken from FIG. 1 with various components omitted for clarity and illustrating principles which may be practiced in a method of assembling a thermostat with a switch device thereof in a predetermined position on the base plate.

Referring now to the drawings in general, there is illustrated a method for assembling a thermostat 21 having a base or base plate 23 with an opening or shaft receiving bore 25 therein (FIGS. 1 and 2). Thermostat 21 is also provided with an encapsulated switch device 27 including switching means, such as a switch blade 28 and armature 29 for instance, adapted for switching operation therein between a pair of opposite switching positions with the switching means having an assembly or at-rest position spaced generally equidistantly between the switching position pair (FIGS. 1 and 5). In this method, encapsulated switch device 27 is arranged on base plate 23 to that switch blade 28 and armature 29 extend generally along a preselected radius line 33 emanating from a centerline axis 31 of opening 25 in the base plate (FIG. 5).

More particularly and with specific reference to FIG. 5, switch device 27 is constructed so that the component parts thereof are disposed generally in magnetic symmetry with respect to each other, as discussed hereinafter. Switch device 27 is provided with a generally elongate, cylindric, hollow tube or casing 35 formed of a non-magnetic material, such as glass for instance, and a generally cylindric side wall 37 of the casing is interposed between a pair of opposite sealed ends or end walls 39, 41 thereof so as to define a sealed chamber 43 within the casing. While sidewall 37 of casing 35 is described and shown herein as being generally cylindric in one form of the invention, it is contemplated that the sidewall of the casing may be provided with other shapes or configurations so as to meet the objects and advantageous features of the invention. Three terminals 45, 47, 49 are predeterminately and sealably disposed generally in spaced side-by-side relation in end wall 41 of casing 35 so that the electrical connection sections of the three terminals extend exteriorly of the casing for connection in an electrical circuit (not shown) of the thermostat 21 with switch means supporting sections of the three terminals being disposed within casing chamber 43. A pair of opposed, predeterminately spaced apart contacts 51, 53 are carried on the supporting section of terminals 45, 49 within chamber 35, and these contacts, which define the aforementioned switching positions of switch blade 28 and armature 29 are each disposed within the chamber so as to be spaced generally equidistantly from sidewall 37 of casing 35. A double contact 55 is carried on switch blade 28 generally adjacent the end portion thereof for making and breaking engagement with contact pair 51, 53, respectively, and one end of switch blade 28 is mounted by suitable means, such as crimping, welding or soldering or the like, to the supporting section of terminal 47 while a generally elongate hollow cylinder or sleeve 57 formed of a magnetic or ferrous material is provided on the opposite end of switch blade and comprises armature 29 within chamber 35. It may be noted that the mass of armature 29 is generally small and that the armature is generally centered within casing 35 thereby to reduce or minimize contact bounce when the armature is magnetically attracted toward its switching positions, as discussed in greater detail hereinafter. With contact pair 51, 53 centered, i.e., disposed generally equidistantly from the sidewalls of the casing, it may be noted that the at-rest position of switch blade 28 and armature 29, as shown in FIG. 5, double contact 55 thereof is spaced generally equidistantly between the contact pair, and the switch blade and armature are disposed or spaced generally equidistantly between the opposite sides of casing sidewall 37. In this manner, the pivotal travel of switch blade 28 and armature 29 generally about the supporting section of terminal 47 from the at-rest position of the switch blade and armature toward the opposite switching positions thereof so as to engage double contact 55 with contact pair 51, 53, respectively, is generally equal, and of course, such travel or displacement is effected upon the magnetic displacement of attraction of the armature, as discussed hereinafter. Thus, magnetic symmetry of armature 29 with respect to contact pair 51, 53 is provided.

As shown in FIGS. 2 and 5, means, such as a mounting bracket 59 or the like, is predeterminately disposed on base plate 23 of thermostat 21 with respect to opening 25 for mounting or otherwise locating or positioning switch device 27 so that it is automatically located or positioned with respect to base plate 23, as discussed in greater detail hereinafter. Mounting means or mounting bracket 59 is connected by suitable means to base plate 23 and provided with a pair of generally resilient or movable tines or mounting fingers 61, 63 which are predeterminately spaced or disposed on opposite sides of radius line 33 emanating from centerline axis 31 of opening 25 in the base plate. While mounting bracket 59 is disclosed as being connected by suitable means to base plate 29, it is contemplated that the mounting bracket may be integrally formed with the base plate in one form of the invention so as to meet the objects and advantageous features thereof. A pair of cradles or locating abutments 65, 67 are integrally formed with base plate 23 on opposite sides of mounting bracket 59, and the cradles are provided with a pair of generally V-shaped locating surfaces 69, 71 which are also predeterminately aligned with radius line 33 emanating from centerline axis 31 of opening 25 in the base plate. While locating surfaces 69, 71 are described as being generally V-shaped in one form of the invention, it is contemplated that the locating surfaces may be provided with other shapes or configurations so as to meet the objects and advantageous features of the invention. In order to assemble or predeterminately locate switch device 27 with respect to thermostat 21, cylindric sidewall 37 of switch casing 35 is inserted or disposed between tines 61, 63 of mounting bracket 59, and the cylindric sidewall of the switch casing is also located on locating surfaces 69, 71 of cradles 65, 67. Since switch blade 28 and armature 29 in the at-rest position and contact pair 51, 53 are centered within casing 35 of switch device 27, as previously mentioned, the switch blade and armature are predeterminately or automatically positioned or disposed so as to extend generally along radius line 33 emanating from centerline axis 31 of opening 25 in base plate 23 when the casing is so located or disposed on locating surfaces 69, 71 of cradles 65, 67 between tines 61, 63 of mounting bracket 59. Thus, switch device 27 is predeterminately or automatically located on base plate 23 with respect to opening 25 therein so as to predetermine the magnetic symmetry of the switch device generally about radius line 33 emanating from centerline axis 33 of the opening. Subsequent to a certain adjusting movement of switch device 27 or cradles 65, 67 generally along radius line 33, as discussed in greater detail hereinafter, a hardenable material 72, such as an epoxy, a silicone rubber or other sealant or the like for instance (as best seen in FIG. 1), is disposed between tines 61, 63 of mounting bracket 59 and cylndric sidewall 37 of casing 35 and solidified in place so as to maintain the switch device against displacement movement.

Figure 6:
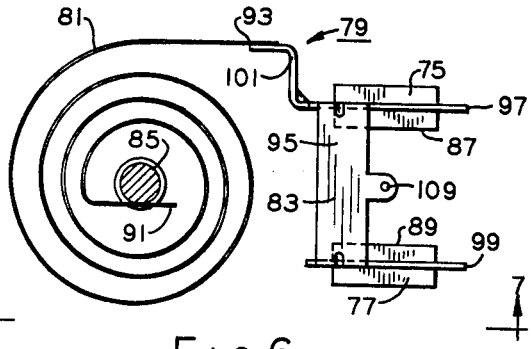
FIG. 6 is an enlarged fragmentary view taken from FIG. 1 showing the switch operation effecting means assembly with an anticipator removed therefrom for clarity.
Figure 7:
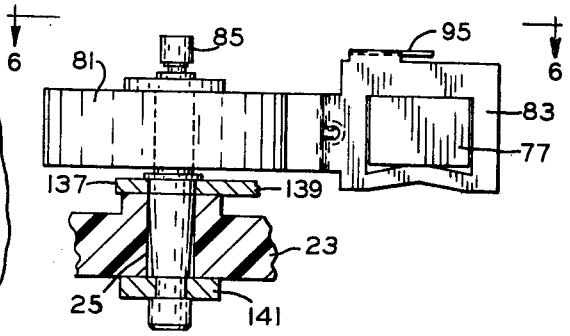
FIG. 7 is a side elevational view of the assembly of FIG. 6 illustrating the mounting thereof to the base plate.
Figure 10:
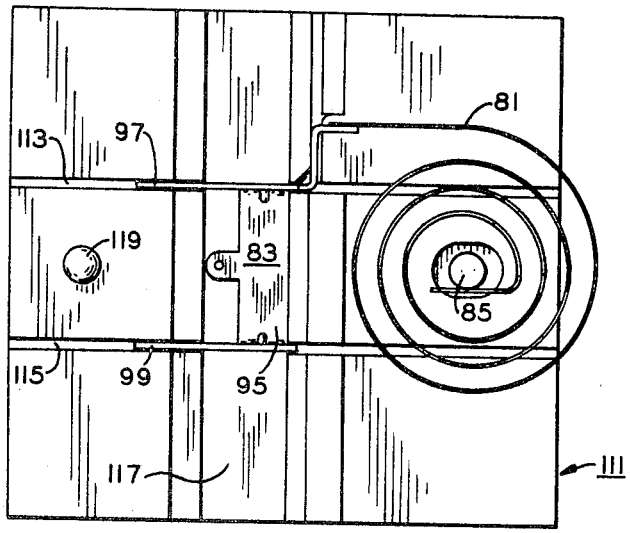
FIG. 10 is a plan view of a fixture showing the assembly of FIG. 6 disposed thereon and illustrating principles which may be practiced in a method of assembling the assembly in one form of the invention.

With reference again to the drawings in general, another method in one form of the invention is illustrated for assembling a pair of magnetic material elements 75, 77 in an assembly 79 having a bimetal element or bimetal means 81 secured between means, such as a bracket 83 or the like, for carrying the magnetic material elements, and means, such as a shaft or post 85 or the like, adapted for supporting or mounting the assembly (FIGS. 6 and 7). In this method, carrying means or carrying bracket 83 is disposed in a fixed position, and a free position of supporting means or shaft 85 is located with respect to the carrying bracket in its fixed position (FIG. 10). Magnetic material elements 75, 77 are then associated with carrying bracket 83 therefor, and a preselected section or opposed generally planar faces 87, 89 of each magnetic material element is arranged so as to be disposed generally in symmetrical relation with shaft 85 in the located free position thereof, respectively (FIG. 12).

Figure 8:
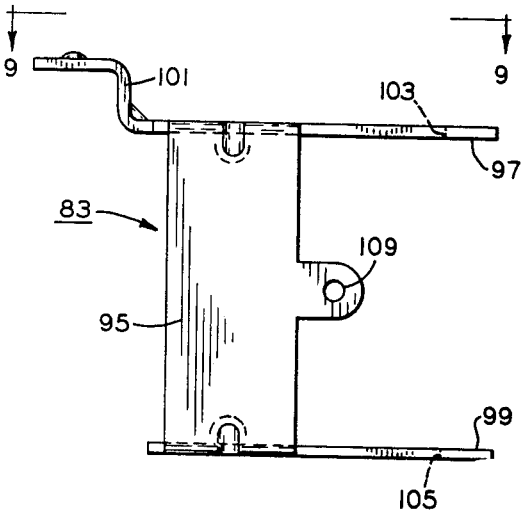
FIG. 8 is an enlarged isolated plan view of a magnet carrying means of the assembly shown in FIGS. 6 and 7.
Figure 9:
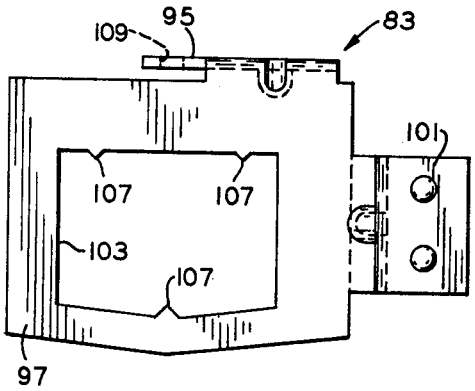
FIG. 9 is an elevational view of the carrying means in FIG. 8.

More particularly and with specific reference to FIGS. 6–9, magnetic material elements 75, 77 may be Plastiform permanent magnets available from the 3M Company, 3M Center, St. Paul, Minnesota, and while the magnetic material elements are shown generally in the shape of a rectangular block, it is contemplated not only that other types of magnets may be employed but also that other shapes may be utilized within the scope of the invention so as to meet the objects thereof. Bimetal element 81 of assembly 79 is provided with a generally spiral configuration, and the bimetal element has a pair of ends or end portions 91, 93 disposed generally in radially spaced relation with respect to each other, as best seen in FIG. 6. Radially inner end portion 91 of bimetal element 81 is attached by suitable means, such as soldering for instance, to shaft 85, and radially outer end portion 93 of the bimetal element is attached by suitable means such as soldering, welding or crimping for instance, with carrying bracket 83. As best seen in FIGS. 8 and 9, carrying bracket 83, which is formed of a non-ferrous material, is provided with a cross piece or arm 95 having a pair of integral oppositely spaced arms or flanges 97, 99 respectively depending therefrom, and one of the depending arms 97 is provided with an integral tab 101 which is connected to radially outer end portion 93 of bimetal element 81, as previously discussed. Depending arms 97, 99 of carrying bracket 83 are provided with a pair of openings 103, 105 adapted to receive magnetic material elements 75, 77, respectively, and a plurality of barbs 107 or the like (as best seen in FIG. 9) are integrally formed on the arms adjacent the upper and lower marginal edges of the openings for gripping engagement with the magnetic material elements when they are received in the openings, as discussed hereinafter. It may be noted that a locating or reference point, such as an aperture 109 in cross piece 97 of carrying bracket 83 is spaced or disposed a preselected distance from the centerline axis of shaft 85 when tab 101 of the carrying bracket is attached or otherwise secured to radially outer end 93 of bimetal element 81, as previously described. Although bimetal element 81 is shown having a generally spiral shape, it is contemplated that a bimetal element shaped other than generally spirally may be utilized in one form of the invention so as to meet the objects thereof.

Figure 12:
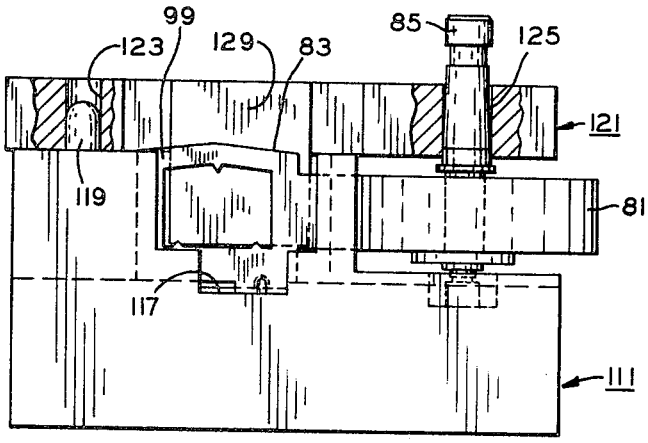
FIG. 12 is an elevational view of the fixture and assembly of FIG. 9 showing the fixture of FIG. 11 associated therewith so as to locate the free position of a shaft of the assembly.
Figure 11:
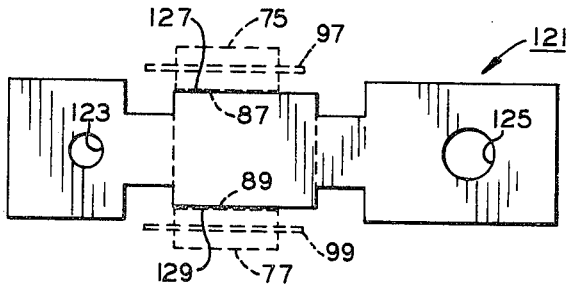
FIG. 11 is a plan view of another fixture adapted for association with the fixture of FIG. 10.

An assembling fixture 111, FIGS. 10 and 12, may be formed, if desired, from either a ferrous or non-ferrous material, and is provided with a pair of predeterminately spaced apart means, such as grooves 113, 115 which are sized for locating or receiving engagement with arms 97, 99 of carrying bracket 83. Groove pair 113, 115 are intersected by means, such as a cross-groove 117, sized for locating or receiving engagement with cross-piece 95 of the carrying bracket. Cross-groove 117 extends generally perpendicular to groove pair 113, 115 intersecting therewith, and a pivoting post 119 is integrally provided on assembling fixture 111 so as to be spaced generally equidistantly between groove pair 113, 115. As shown in FIGS. 11 and 12, another assembling fixture or centering block 121 is formed from either a ferrous material or a non-ferrous material, such as a plastic or the like for instance. Centering block 121 is provided with a pair of predeterminately spaced apart pivot pin receiving and shaft locating apertures or openings 123, 125 therethrough adjacent the opposite ends of the centering block and a pair of depending opposite centering or locating surfaces or faces 127, 129 which are generally planar are provided on the centering block intermediate the apertures thereof. Centering surfaces 127, 129 are predeterminately arranged with opening 125 in centering block 121 so as to extend in planes which are generally symmetrical with respect to or about shaft locating opening 125.

In order to locate carrying bracket 83 of assembly 79 in its fixed position, as previously mentioned, depending arms 97, 99 of the carrying bracket are disposed or inserted generally edge-wise into the spaced apart groove pair 113, 115 of assembling fixture 111, and cross piece 95 of the carrying bracket is disposed or inserted into cross groove 117 of the assembling fixture. It may be noticed that the locating or positioning abutment or engagement of depending arms 97, 99 of carrying bracket 83 within groove pair 113, 115 and that of cross piece 95 within cross groove 117 generally obviates displacement movement of the carrying bracket when it is so mounted in its fixed position on assembling fixture 111. With carrying bracket 83 so disposed in its fixed position, it may be noted that bimetal element 81 and shaft 85 attached thereto are free and may move so as to ascertain the free position of the shaft with respect to the carrying bracket located in its fixed position on assembling fixture 111. Thus, with carrying bracket 83 in its fixed position and shaft 85 in its free position, centering block 121 is assembled with assembling fixture 111 and assembly 79 so that aperture 123 in the centering block is disposed in locating engagement about pivot pin 119 of the assembling fixture with locating aperture 125 in the centering block disposed over or generally about shaft 85 in its free position thereby to positively locate the free position of the shaft with respect to carrying bracket 83 in its fixed position. With centering block 121 so mounted with assembling fixture pivot pin 119 and shaft 85 of assembly 79, it may be noted that centering surfaces 127, 129 on the centering block are also predeterminately located so as to extend in the planes which are now symmetrical not only with respect to locating aperture 125 in the centering block, as previously mentioned, but also with respect to the shaft 85 in its located free position disposed within the locating aperture. At this time, magnetic material elements 75, 77 may be inserted into predetermined or located positions through openings 103, 105 in depending arms 97, 99 of carrying bracket 83 so that opposed faces 87, 89 of the magnetic material elements may be moved into generally planar abutting engagements with centering surfaces 127, 129 on centering block 121. With opposed faces 87, 89 of magnetic material elements 75, 77 so disposed in the generally planar abutting engagement with centering surfaces 127, 129 of centering block 121, it may be noted that the opposed faces of the magnetic material elements are now also predeterminately positioned or located to generally extend in the planes of the centering surfaces of the centering block thereby to be arranged generally symmetrically with respect to shaft 85 in its located free position. If desired, a slight holding force may be applied generally simultaneously onto magnetic material elements 75, 77 to hold them against surfaces 127, 129 so as to create or establish the desired magnet air gap. At this time, a tool (not shown) may be brought into engagement with each of arms 97, 99 of carrying bracket 83 so as to stake or otherwise deform the arms into holding or gripping engagement with magnetic material elements 75, 77, and barbs 107 are, of course, driven into the side edges of the magnetic material elements.

Figure 13:
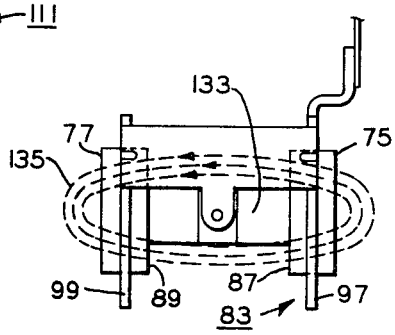
FIG. 13 is a fragmentary view illustrating the assembly of FIG. 6 located therein for magnetizing the magnetic material elements of the assembly.

With magnet material elements 75, 77 so fixed in their predetermined positions within openings 103, 105 of carrying bracket 83, as described above, assembly 79 may now be transferred to an electrical charging or magnetizing device (not shown). Carrying bracket 83 may be disposed in a charging fixture of the aforementioned electrical charging or magnetizing device with a charging bar 133 thereof arranged in abutting engagement between opposing faces 87, 89 of magnetic material elements 75, 77 generally midway thereof, as shown in FIG. 13, and an electrical current is then applied to the charging bar in order to magnetize the magnetic material elements. The electrical charging device for effecting the magnetization of magnetic material elements 75, 77 may be a Magnet Charger Model 1500 available from RFL Industries, Inc., Boonton, New Jersey. As illustrated in FIG. 13, magnetic flux lines, shown schematically at 135, effected upon the electrical charging of charging bar 133 are predetermined so that opposite ones of opposed faces 87, 89 of magnetic material elements 75, 77 are magnetized as north and south poles depending upon the direction of the flux lines entering and leaving the magnetic material elements.

In an alternative method of assembling assembly 79 in one form of the invention, assume that magnetic material elements 75, 77 are magnetized so as to be actual magnets prior to the assembly thereof within openings 103, 105 of carrying bracket 83 when assembly 79 is positioned with respect to assembling fixture 111 and centering block 121 as previously described. In this alternative method, centering block 121 or at least the opposite surfaces 127, 129 thereof are formed of a ferrous material. Thus, when magnets 75, 77 are moved or inserted through openings 103, 105 in arms 97, 99 of carrying bracket 83 toward opposed surfaces 127, 129 of centering block 121, opposing faces 87, 89 of the magnets are attracted into magnetic holding engagement with the surfaces of the centering block, and upon such magnetic engagement, the opposed faces of the magnets are predeterminately positioned or located to generally extend in the planes of the centering surfaces thereby to be arranged generally symmetrically with respect to shaft 85 in its located free position. Thereafter, arms 97, 99 of carrying bracket 83 may be deformed into retaining engagement with magnets 75, 77 in their predetermined positions in the same manner as previously described hereinabove. While this alternative method of assembling assembly 79 meets at least some of the objects and advantageous features of the invention set out hereinbefore, it is believed that such alternative method may also have other objects and advantageous features of its own.

Subsequent to the magnetizing of magnetic material elements 75, 77 mounted to carrying bracket 83 therefor in the predetermined symmetrical relation with respect to shaft 85 of assembly 79, as described above, a bifurcated end 137 of a temperature selector, such as a lever 139 or the like, is inserted or disposed in gripping engagement with the shaft, and the assembly and temperature selector is mounted on base plate 23 of thermostat 21 in order to dispose the assembly in magnetic symmetry with switch device 27, as best seen in FIGS. 1 and 7. In the assembling of assembly 79 to base plate 23 of thermostat 21, shaft 85 is inserted into rotatable or pivotal engagement within opening 25 in the base plate so that magnets 75, 77 are disposed in straddling relation with respect to switch device 27, i.e. on opposite sides of casing 37 thereof. At this time, means, such as a spring clip or retainer 141 or the like, for retaining shaft 85 against displacement from opening 25 in base plate 23 is inserted or otherwise disposed in engagement between the lower end of the shaft and the base plate generally about the opening therein, as best seen in FIG. 7. Thereafter, calibration of assembly 79 may be effected in a preselected temperature environment. In calibrating assembly 79, shaft 85 may be held or otherwise fixed by suitable means (not shown) against further rotation in opening 25 of base plate 23, and temperature selector 139 is pivoted or rotated about the shaft to a position correlative with or indicative of the environmental preselected temperature. Since armature 29 of switch device 27 extends generally along radius line 31 emanating from centerline axis 33 of opening 25 in base plate 23 of thermostat 21 and opposed faces 87, 89 of magnetic material elements 75, 77 are arranged so as to be generally symmetrical with shaft 85 in its free position, as rotatably disposed in the opening, it may be noted that the faces of the magnetic material elements are pivotally movable about the shaft so as to approach sidewall 37 on casing 35 of the switch device at generally the same angles, as discussed hereinafter, thereby to predetermine the magnetic symmetry of assembly 79 with respect to the switch device, as best seen in FIG. 1. Of course, when magnetic material element 75 is so disposed in engagement with casing sidewall 37 of switch device 27, the magnetic material element attracts armature 29 toward it. Thus, armature 29 is displaced from its at-rest position extending generally along radius line 33 to one of the aforementioned switching positions engaging double contact 55 on switch blade 28 with contact 51 carried by terminal 45. Either prior or subsequent to the calibration of assembly 79 when rotatably mounted to base plate 23 of thermostat 21, as discussed above, switch device 27 may be adjustably moved on cradles 65, 67 toward or away from opening 25 and with respect to magnetic material elements 75, 77 so as to predetermine the force of the magnetic attraction or coupling relation between armature 29 of the switch device and the magnetic material elements. Thereafter, sealant 72 is applied to casing 35 of switch device 27 and mounting bracket 59 therefor, as previously discussed, and it should be noted that such adjusting movement of the switch device on cradles 65, 67 does not affect the predetermined symmetry or alignment of the switch device with respect to centerline axis 33 of opening 25, as previously discussed.

With reference again to the drawings in general and recapitulating at least in part with respect to the foregoing, assembly 79 is illustrated so as to be adapted for effecting a switching operation in thermostat 21. Assembly 79 includes a pair of magnets, such as the magnetic material elements 75, 77, and means, such as shaft 85, adapted for rotatably mounting or supporting the assembly with respect to thermostat 21 (FIGS. 1 and 6). Further, means, such as carrying bracket 83, is provided for carrying magnets 75, 77 in generally opposed spaced apart relation, and bimetal element 81 is disposed between the mounting or supporting means or shaft 85 and the carrying means or carrying bracket 83 and is secured thereto, respectively (FIGS. 6 and 7).

Still further with respect to the drawings in general and again recapitulating at least in part with respect to the foregoing, thermostat 21 (FIG. 1) is provided for regulating the temperature of a space (not shown) in which the thermostat may be located. In thermostat 21, means, such as bimetal element 81, is movable on the thermostat for sensing the temperature of the space, and switch device 27 has means therein, such as switch blade 28 and armature 29, for switching between a pair of switching positions (FIG. 5). A pair of permanent magnet means, such as the magnet material elements 75, 77, is provided for magnetic coupling relation with the switching means, respectively, and means, such as carrying bracket 83, is provided for translating the temperature sensing movement of the sensing means or bimetal element 81 to the magnet means pair or magnetic material elements so as to attract the switching means from one of its switching positions to the other thereof, as previously discussed (FIGS. 1, 5 and 6). Translating means or carrying bracket 83 includes a pair of means, such as depending arms 103, 105, connected with each other for mounting magnetic material elements 75, 77 adjacent switch device 27 in the magnetic coupling relation with armature 29 thereof, and means, such as tab 101, extends from at least one of the mounting means or depending arms 103, 105 for securing engagement with bimetal element 81 so that the magnetic material elements are conjointly movable with the bimetal element and with respect to switch device 27 upon the temperature sensing movement of the bimetal element to effect the attraction of armature 29 and move the switching means from its one switching position to its other switching position (FIGS. 1 and 5–9).

Figure 3:
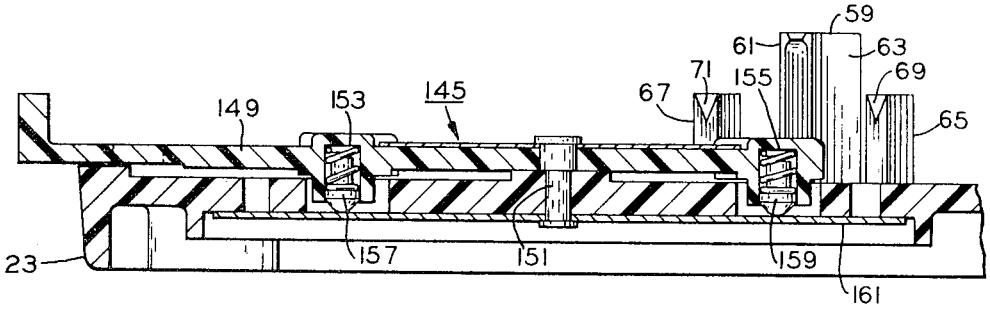
FIGS. 3 and 4 are sectional views taken along lines 3—3 and 4—4 of FIG. 2, respectively.
Figure 4:
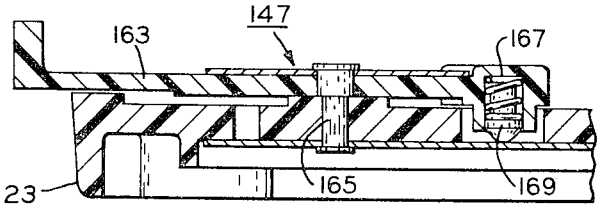

More particularly and with specific reference to FIGS. 1–4, base plate 23 of thermostat 21 is provided with means, such as a plurality of split posts 143 or the like respectively at each corner of the base plate, for releasable securing engagement with a cover (not shown) for the thermostat, and such cover may contain temperature setting indicia appropriately positioned with respect to temperature selector 139 as well as other indicia concerning the settings of both a system or mode selector switch and a fan switch, indicated generally at 145, 147, respectively, of the thermostat. System selector switch 145 (as best seen in FIG. 3) has a generally flat elongate lever 149 which is pivotally or rotatably mounted on a pivot post or pin 151 secured to base plate 23, and the lever is provided with a pair of spaced apart recesses 153, 155 which house a pair of spring loaded, indexing type contacts 157, 159, respectively. Contacts 157, 159 of system selector switch are resiliently urged toward electrical contacting engagement with a stamped-out metallic circuit board or plate, indicated generally at 161. Of course, lever 149 of system selector switch 145 is manually pivotally movable about pivot pin 151 between three operating positions, i.e. "off", "heat", and "cool" positions, so as to select the desired operating mode of thermostat 21, and upon such pivotal movement of the lever, contacts 157, 159 are respectively resiliently urged or indexed into electrical contacting engagement between various stamped-out parts (not shown) of circuit plate 161 to effect the heating or cooling mode operations of the thermostat or to turn off the thermostat. As best seen in FIG. 4, fan switch 147 also is provided with a generally flat elongate lever 163 which is pivotally or rotatably mounted on a pivot post or pin 165 secured to base plate 23, and a recess 167 is provided in the lever generally adjacent an end thereof. Another spring loaded, indexing type contact 169 is housed in recess 167 of lever 163 and is resiliently urged toward electrical contacting engagement with circuit plate 161. Of course, lever 163 of fan switch 147 is manually pivotally movable about pivot pin 165 between an "on" position and an "automatic" position so as to select the desired operation of a fan or blower (not shown) during the heating or cooling mode operation of thermostat 21. Upon the pivotal movement of lever 163, contact 169 is resiliently urged or indexed into electrical contacting engagement between various stamped-out parts (not shown) of circuit plate 161 to effect the aforementioned desired operation or mode of the fan. Although system selector switch 145, fan switch 147 and circuit plate 161 are described hereinabove in one form of the invention, it is contemplated that other types or forms of system selector switches, fan switches and circuitry may be utilized in thermostat 21 so as to meet the objects and advantages features thereof. Further, while circuit plate 161 is illustrated as secured by pivot pins 151, 165 to base plate 23 of thermostat 21, it is contemplated that other means for securing the circuit plate to the base plate may also be utilized within the scope of the invention so as to meet the objects thereof. Further, if a more detailed discussion of the circuitry included in circuit plate 161 is desired, reference may be had to the thermostat circuitry disclosed in the Wiley M. Hummel U.S. Pat. No. 4,016,520 issued Apr. 5, 1977 which is incorporated herein by reference.

As shown in FIG. 1, a heat anticipator assembly 171 is secured to the upper end of shaft 85 so as to extend generally adjacent and over bimetal element 81 secured to the shaft, as discussed in detail hereinabove. Heat anticipator assembly 171 is connected by a lead 173 in circuit relation with circuit plate 161, and when energized, the heat anticipator assembly is operable to transmit anticipation heat directly to bimetal element 81 so as to prevent temperature overshoot or undershoot, as is well known in the art. To complete the description of thermostat 21, a plurality of leads 175 are respectively connected in circuit relation between terminals 45, 47, 49 of switch device 27 and circuit plate 161 so that the switching operation of the switch device is effective when system selector switch is disposed in one of its heating or cooling operating mode positions. If a more detailed discussion of the function of a heat anticipator, such as heat anticipator assembly 171, in a thermostat is desired, reference may be had to the copending Dann W. Denny application Ser. No. 750,280 filed Dec. 13, 1976 now U.S. Pat. No. 4,114,681 issued Sept. 17, 1978 which is incorporated herein by reference.

If an operator desires to effect the heating mode operation of thermostat 21 so as to effect heating of the space in which the thermostat may be located, lever 149 of system selector switch 145 is manually pivoted about pivot pin 151 so as to index contacts 157, 159 into positions in electrical contacting engagement with circuit plate 161 effecting the "heat" mode position of the system selector switch and the heating mode operation of thermostat 21, FIGS. 1 and 3. Of course, lever 163 of fan switch 147 may also be manually pivoted about pivot pin 165 so as to index contact 169 into a position in electrical contacting engagement with circuit plate 161 effecting a desired one of the "on" or "automatic" position of the fan switch, as desired, FIGS. 1 and 4. With system selector switch 145 and fan switch 147 so disposed in the desired positions thereof, as discussed above, the operator may now select a set-point temperature desired for the space in which thermostat 21 is located by exerting an applied force on temperature selector 139 so as to rotate it in a generally clockwise direction, as best seen in FIG. 1, toward the desired or selected temperature setting thereof, say 70° F. for instance. The operator applied force movement or rotation of temperature selector 139 effects the conjoint rotation therewith of shaft 85 within opening 25 of base plate 23, FIG. 7, and since bimetal element 81 is carried on shaft 85, the bimetal element is conjointly rotatable therewith to an adjusted position correlative with the set-point temperature indicated by temperature selector 139. Of course, this conjoint rotation of bimetal element 81 with shaft 85 is translated by carrying bracket 83 into conjoint pivotal movement or rotation of magnets 75, 77 about the shaft. Thus, as the torque of bimetal element 81 exceeds the magnetic attraction between armature 29 and magnet 77, the magnets 75, 77 are rotated generally in a clockwise direction about shaft 85 with snap action; therefore, magnet 77 is positioned farther away from armature 29 of switch device 27 so as to decrease the magnitude of the magnetic coupling or attraction force therebetween. When the magnitude of the magnetic attraction force between armature 29 and magnet 75 exceeds that between the armature and magnet 77, the armature will move or snap in a direction toward magnet 75 so as to break double contact 55 from contact 53 and make the double contact with contact 51, FIGS. 1 and 5. Thus, as shown in FIG. 1, in the aforementioned adjusted position of bimetal element 81, magnet 75 is disposed in abutment with sidewall 37 casing 35 of switch device 27, and armature 29 is attracted in magnetic coupling relation toward magnet 75 so as to make double contact 55 on the armature with contact 51 of the switch device. When double contact 55 is engaged with contact 51, a heating system (not shown) is enabled or energized for conditioning the air of the space in which thermostat 21 is located since system selector switch 145 is in its heat mode position, as previously mentioned.

Of course, bimetal element 81 is also movable in its adjusted position with respect to shaft 85 so as to generally wind and unwind in the clockwise and counterclockwise directions thereabout, respectively, in response to the particular temperature of the space sensed by the bimetal element. With the temperature of the space being increased or heated upon the enablement of the heating system and/or anticipator 171, bimetal element 81 expands creating a force tending to move or rotate its radially outer end 93 generally in the counterclockwise direction with respect to shaft 85. This increasing torque on bimetal element outer end 93 conjointly pivotally urges carrying bracket 83 and magnets 75, 77 in the counterclockwise direction with respect to shaft 85. Thus, as the temperature of the space is increased to the selected temperature of 70° F., the magnitude of the expansive force of bimetal element 81 exceeds that of the attraction force between magnet 75 and armature 29 so that assembly 79 will move its magnets 75, 77 with snap action in the counter-clockwise direction about shaft 85 toward a position in which magnet 77 is disposed in engagement with sidewall 37 on casing 35 of switch device 27. Thus, upon this temperature sensing rotation of bimetal element 81 in its adjusted position, armature 29 is attracted in magnetic coupling relation toward magnet 77 so as to make double contact 55 on switch blade 28 with contact 53 of the switch device since the attraction force between the armature and magnet 77 is now greater than that between the armature and magnet 75. When double contact 55 is so engaged with contact 53, the heating system is disabled or deenergized as well as heat anticipator assembly 171.

With the heating system so deenergized, the temperature of the conditioned air in the space in which thermostat 21 may be located, of course, falls, and at a preselected differential in excess of the selected temperature setting, bimetal element 81 will contract to a degree creating a contractive force to effect the return conjoint rotation with snap action of carrying bracket 83 and magnets 75, 77 to their respective adjusted positions, as previously mentioned, thereby to re-energize the heating system to again increase the temperature of the conditioned air in the space to the selected temperature of 70° F. Upon the return rotation of magnets 75, 77 to the adjusted position of bimetal 81, as previously discussed, armature 29 is attracted in magnetic coupling relation toward magnet 75 so as to disengage double contact 55 from contact 53 and remake the double contact with contact 51 of switch device 27. Of course, this operation of assembly 79 to effect the switching operation of switch device 27, as previously discussed, in order to control the heating system may be cyclically or periodically repeated in response to the temperature demands of the space in which thermostat 21 is located so as to generally maintain the selected temperature of the space.

Further, if the operator desires to effect the cooling operating mode of thermostat 21, system selector switch 145 is manually rotated from its "heat" position to its "cool" position so as to enable to energize a cooling system for conditioning the air of the space in which thermostat 21 is located, and the component parts of the thermostat function in the same manner as previously described in order to control the operation of the cooling system in response to the temperature demands of the space so as to generally maintain the selected temperature of the space.

From the foregoing, it is now apparent that a novel method of assembling components of a thermostat are presented meeting the objects and advantageous features set out hereinbefore, as well as others, and that changes as to the precise arrangements, shapes, connections and details of the constructions illustrated herein by way of example for purposes of disclosure, as well as the precise steps and order thereof of the method, may be made by those having ordinary skill in the art without departing from the spirit of the invention or the scope thereof as defined by the claims which follow.

What I claim as new and desire to secure by Letters Patent of the United States:

1. A method of assembling a pair of magnetic material elements with an assembly having a bimetal element secured between means for carrying the magnetic material elements and means adapted for supporting the assembly, the method comprising the steps of:

(a) disposing the carrying means in a fixed position;

(b) locating a free position of the supporting means with respect to the carrying means in its fixed position; and (c) associating the magnetic material elements with the carrying means therefor and arranging a preselected section of each magnetic material element so as to be disposed generally in symmetrical relation with the supporting means in the located free position thereof, respectively.

2. The method as set forth in claim 1 comprising the additional step of securing the magnetic material elements to the carrying means with the preselected section of the magnetic material elements disposed generally in the symmetrical relation with the supporting means in the located free position thereof.

3. The method as set forth in claim 2 wherein the securing step includes deforming at least a part of the carrying means into displacement preventing engagement with each of the magnetic material elements, respectively.

4. The method as set forth in claim 1 comprising the additional step of magnetizing the magnetic material elements.

5. The method as set forth in claim 1 comprising the additional step of securing the magnetic material elements to the carrying means therefor and magnetizing the magnetic material elements.

6. The method as set forth in claim 1 wherein the associating and arranging step includes disposing the magnetic material elements on the carrying means therefor with the preselected sections generally in opposed spaced relation with each other.

7. The method as set forth in claim 1 wherein the associating and arranging step includes disposing the preselected section of each magnetic material element in a preselected position with respect to the located free position of the supporting means so as to effect the symmetrical relation of the preselected sections with the supporting means.

8. The method as set forth in claim 1 wherein the bimetal element has a generally spiral configuration with a pair of generally radially spaced inner and outer ends, the carrying means being secured to the outer end and the supporting means being secured to the inner end.

9. The method as set forth in claim 1 wherein the carrying means has a pair of spaced apart openings therein in which the magnetic material elements are received generally in opposed relation.

10. A method of assembling a pair of magnets with an assembly having a bimetal element secured between means for carrying the magnets and means adapted for supporting the assembly, the method comprising the steps of:

(a) disposing the carrying means in a fixed position;

(b) locating a free position of the supporting means with respect to the carrying means in its fixed position; and (c) associating the magnets with the carrying means in its fixed position and attracting a preselected section of each of the magnets into magnetic coupling relation with a pair of means for predeterminately disposing the preselected sections of the magnets generally in symmetrical relation with the supporting means in the located free position thereof.

11. A method of assembling a pair of magnetic material elements to an assembly arranged with a pair of fixtures, the assembly having a bimetal element secured between a pair of means for carrying the magnetic material elements and means adapted for supporting the assembly, the method comprising the steps of:

(a) disposing the carrying means in a fixed position on one of the fixtures with the bimetal element and the supporting means being free to attain a free position with respect to the one fixture and the carrying means in the fixed position thereof;

(b) associating the other of the fixtures with the one fixture and the suporting means to locate the free position thereof; and (c) moving the magnetic material elements with respect to the carrying means and the fixtures and engaging a preselected section of each magnetic material element with a pair of predeterminately positioned abutments on the other fixture so that when the preselected sections are engaged with the abutments the preselected sections are disposed generally in symmetrical relation with the supporting means in the located free position thereof.

* * * * *